United States Patent [19]

Horning, Jr.

[11] Patent Number: 5,007,171

[45] Date of Patent: Apr. 16, 1991

[54] BAG OPENER APPARATUS

[76] Inventor: John H. Horning, Jr., 51934 Lily Rd., South Bend, Ind. 46637

[21] Appl. No.: 519,810

[22] Filed: May 7, 1990

[51] Int. Cl.[5] ..... B67B 7/00

[52] U.S. Cl. ..... 30/294; 30/2; 30/278; 30/DIG. 3

[58] Field of Search ..... 414/412; 30/2, 278, 30/280, 314, 334, DIG. 3, 294

[56] References Cited

U.S. PATENT DOCUMENTS

| | | | |
|---|---|---|---|
| D. 256,883 | 9/1980 | Wharmby | 30/DIG. 3 |
| 1,659,124 | 2/1928 | Sullivan | 30/334 |
| 2,649,656 | 8/1953 | Hedrick | 30/DIG. 3 |
| 2,815,572 | 12/1957 | Deicken | 30/DIG. 3 |
| 3,142,119 | 7/1964 | O'Brien | 30/278 |
| 4,360,970 | 11/1982 | Ostroski et al. | 30/DIG. 3 |
| 4,530,154 | 7/1985 | DiCarlo | 30/DIG. 3 |
| 4,581,823 | 4/1986 | Gilman | 30/280 |
| 4,711,031 | 12/1987 | Annello | 30/DIG. 3 |

FOREIGN PATENT DOCUMENTS

| | | | |
|---|---|---|---|
| 1455919 | 11/1976 | United Kingdom | 30/294 |

*Primary Examiner*—Robert J. Spar
*Assistant Examiner*—Robert S. Katz
*Attorney, Agent, or Firm*—Leon Gilden

[57] ABSTRACT

A bag opener of a generally "U" shaped configuration formed of a memory retentent polymeric material, including a first leg and a second leg arranged parallel relative to one another in a first position, and wherein a blade member is mounted within an interior surface of the first leg arranged parallel to beveled terminal ends of the legs to receive a bag therethrough, wherein the blade member is directed across the surface of a bag inserted between the interior surfaces of the leg members to sever a bag positioned therewithin.

1 Claim, 4 Drawing Sheets

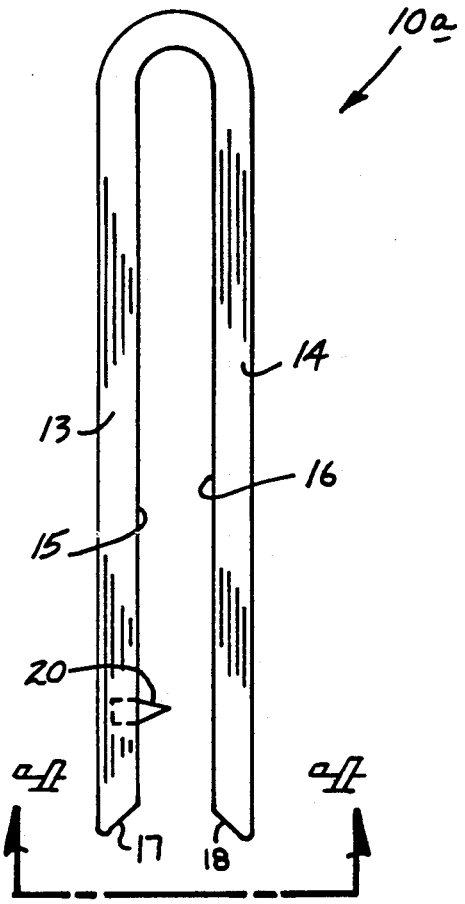
FIG 3
FIG 4
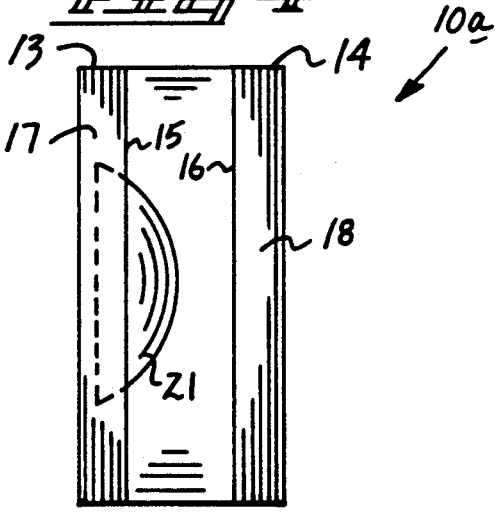

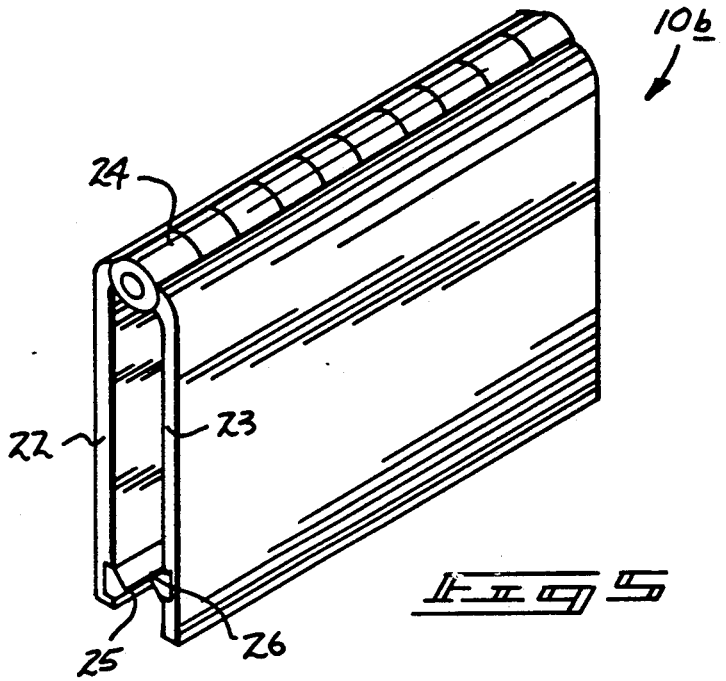
Fig 5
Fig 6
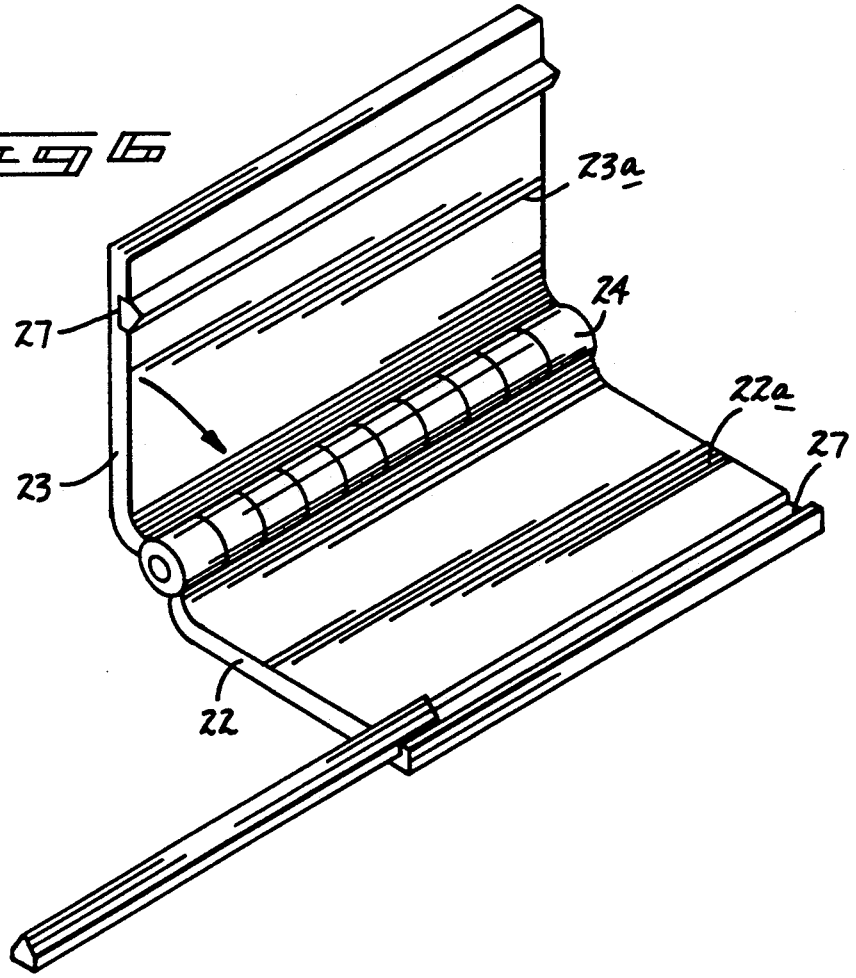

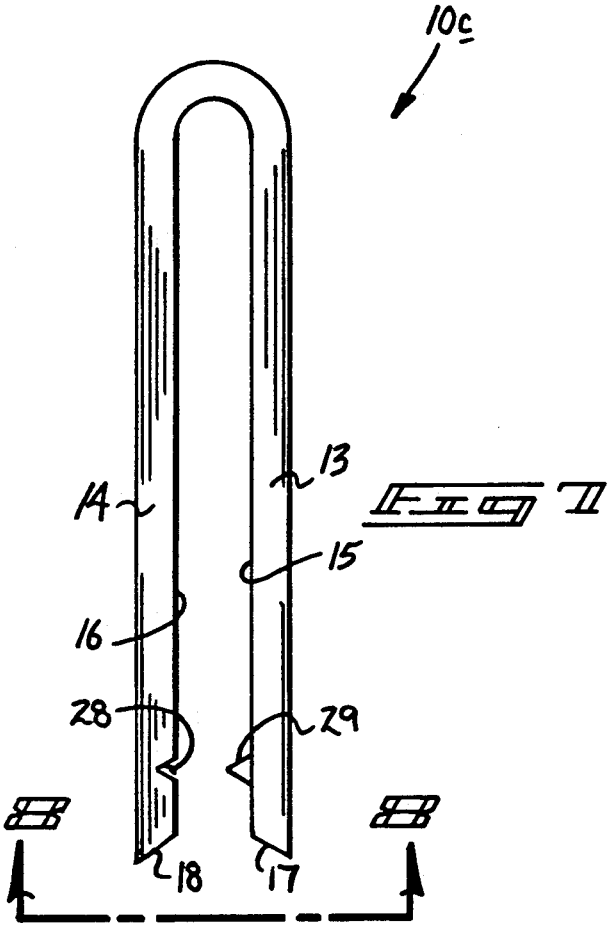
FIG 7
FIG 8
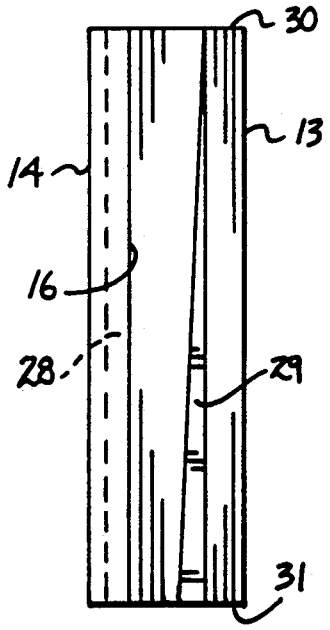

BAG OPENER APPARATUS

BACKGROUND OF THE INVENTION

1. Field of the Invention

The field of invention relates to severing apparatus, and more particularly pertains to a new and improved bag opener apparatus wherein the same permits reception of a conventional bag within the apparatus to permit severing of the bag as the apparatus is manually directed across an upper end of the bag.

2. Description of the Prior Art

Various food components, as well as other assorted merchandise, is conventionally packaged within polymeric type bags. Modern seaming and enclosure apparatus and technics have effected an air-tight closure bag that at times discourages opening dependent upon bag thickness and tensile strength. The instant invention sets forth a simple, yet effective, organization to permit severing and opening of bag structures adjacent a seamed edge thereof advantageously over prior art devices. Examples of prior art opening type apparatus may be found in U.S. Pat. No. 4,455,894 to Roberts wherein a hand-held opening apparatus includes a generally elongate member defined with a central aperture for opening of bottle caps and the like, with a slotted end portion mounting the cutting blade therewithin for severing of various articles.

U.S. Pat. No. 3,948,402 to Schott, Jr. sets forth a bag opening and emptying machine pressing a platen against associated blades with a bag therebetween for opening of the bag structure.

U.S. Pat. No. 4,034,877 to Bennison sets forth a bag opening machine utilizing a medially positioned blade cooperative between spaced rollers for opening of a bag directed therebetween.

U.S. Pat. No. 4,252,489 to Mechalas provides a "V" shaped opening blade positioned at a lowermost end of a chute for directing a bag against the blade for opening of the bag.

As such, it may be appreciated that there continues to be a need for a new and improved bag opener apparatus wherein the same addresses both the problems of ease of use, as well as effectiveness in construction and in this respect, the present invention substantially fulfills this need.

SUMMARY OF THE INVENTION

In view of the foregoing disadvantages inherent in the known types of bag opening apparatus now present in the prior art, the present invention provides a bag opener apparatus wherein the same sets forth a manually manipulated, generally "U" shaped, bag opener apparatus permitting reception of a bag seamed edge therebetween and also permits engagement of the bag between interior surfaces of the apparatus for severing of the bag member as the apparatus is drawn across the seamed edge portion of the bag. As such, the general purpose of the present invention, which will be described subsequently in greater detail, is to provide a new and improved bag opener apparatus which has all the advantages of the prior art bag opening apparatus and none of the disadvantages.

To attain this, the present invention provides a bag opener of a generally "U" shaped configuration formed of a memory retentent polymeric material, including a first leg and a second leg arranged parallel relative to one another in a first portion, and wherein a blade member is mounted within an interior surface of the first leg arranged parallel to beveled terminal ends of the legs to receive a bag therethrough, wherein the blade member is directed across the surface of a bag inserted between the interior surfaces of the leg members to sever a bag positioned therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bag opener apparatus which has all the advantages of the prior art bag opening apparatus and none of the disadvantages.

It is another object of the present invention to provide a new and improved bag opener apparatus which may be easily and efficiently manufactured and marketed.

It is a further object of the present invention to provide a new and improved bag opener apparatus which is of a durable and reliable construction.

An even further object of the present invention is to provide a new and improved bag opener apparatus which is susceptible of a low cost of manufacture with regard to both materials and labor, and which accordingly is then susceptible of low prices of sale to the consuming public, thereby making such bag opener apparatus economically available to the buying public.

Still yet another object of the present invention is to provide a new and improved bag opener apparatus which provides in the apparatuses and methods of the prior art some of the advantages thereof, while simultaneously overcoming some of the disadvantages normally associated therewith.

Still another object of the present invention is to provide a new and improved bag opener apparatus wherein the same permits ease of manipulation of a "U" shaped member across a seamed edge of a bag for ease of opening of the bag member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view of a modification of the instant invention.

FIG. 4 is an orthographic end view of a modification of the instant invention, taken along the lines 4—4 of FIG. 3 in the direction indicated by the arrows.

FIG. 5 is an isometric illustration of a further modified bag opener of the instant invention.

FIG. 6 is an isometric illustration of the bag opener, as illustrated in FIG. 5, in an opened configuration.

FIG. 7 is an orthographic side view, taken in elevation, of a yet further modified bag opener of the instant invention.

FIG. 8 is an orthographic view, taken along the lines 8—8 of FIG. 7 in the direction indicated by the arrows.

DESCRIPTION OF THE PREFERRED EMBODIMENT

Figure 1:
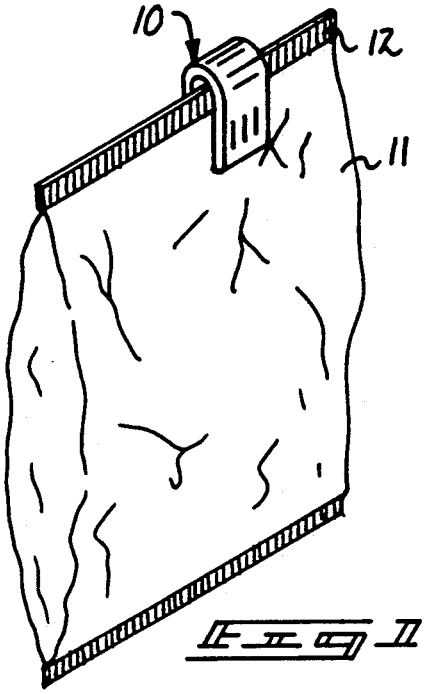
FIG. 1 is an isometric illustration of the instant invention in association with a bag to be opened.

With reference now to the drawings, and in particular to FIGS. 1 to 8 thereof, a new and improved bag opener apparatus embodying the principles and concepts of the present invention and generally designated by the reference numerals 10, 10*a*, 10*b*, and 10*c* will be described.

Figure 2:
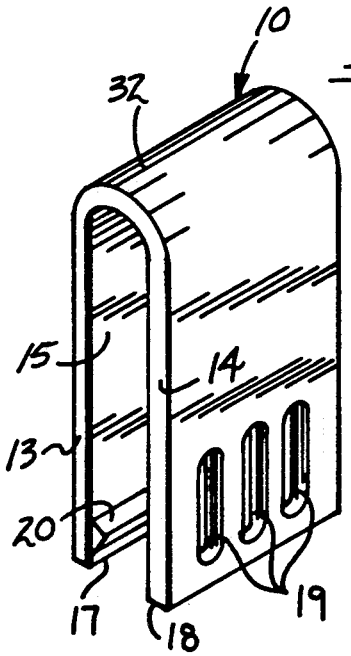
FIG. 2 is an isometric illustration of the instant invention.

More specifically, the bag opener apparatus 10 as illustrated in FIG. 1, essentially cooperates with a flexible bag 11 and receives a bag 11 interiorly of the generally "U" shaped body of the apparatus 10, with the bag seam 12 positioned against an interior surface of the apparatus. FIG. 2 illustrates the apparatus 10, including a first leg 13 coextensive with and overlying a second leg 14, wherein the first and second legs 13 and 14 define the spaced parallel legs of the "U" shaped body joined at an elongate arcuate intersection 32. The thusly formed body is formed of a memory retentent deformable material such as polymeric, metallic, and the like, to effect a "spring-back" of the "U" shaped body to the first position, as illustration in FIG. 2, from a second position when the first and second legs 13 and 14 are squeezed relative to one another to secure the bag 11 therebetween to effect a severing operation. The first and second legs 13 and 14 each include a respective planar first and second interior surface 15 and 16 that are each arranged parallel to one another in the first position. The first interior surface 15 includes a cutting blade 20 mounted coextensively and orthogonally across the defined width of the first leg 13 and arranged parallel to first and second beveled terminal end surfaces 17 and 18. The end surfaces 17 and 18 are beveled in a confronting relationship to readily receive the bag 11 therebetween. A series of spaced finger recesses 19 are formed on an exterior surface of the second leg 14 and arranged orthogonally relative to the second terminal end 18 to enhance manual grasping of the organization.

FIGS. 3 and 4 illustrates a modified apparatus 10*a* utilizing a semi-circular cutting blade 21 positioned medially of the interior surface 15 and arranged parallel to the end surfaces 17 and 18. The semi-circular cutting blade 21 is positioned at equal spacing from each side surface of the first leg 13, wherein the semi-circular configuration of the cutting blade 20 readily accommodates a piercing and severing of an associated bag 11 as the apparatus 10*a* is drawn across the bag 11 adjacent the seam 12 to effect a removal of the seam portion 12 subsequent to the severing procedure.

FIGS. 5 and 6 illustrate a further embodiment of the organization defining a bag opener apparatus 10*b*, wherein a first and second leg 22 and 23 each include a respective interior surface 22*a* and 23*a*, and are biased towards one another by use of a spring hinge 24 to define the "U" shaped body. A respective first and second cutting blade 25 and 26 whose edges are aligned and parallel when the first and second legs are in the first position and are replaceable and removable from associated knife grooves 27 formed within each first and second leg adjacent the terminal end edges. The first and second legs 22 and 23 are accordingly deformable to the aforenoted second position to engage a bag therebetween for severing and removal of the associated bag seam 12.

FIGS. 7 and 8 illustrate a yet further modification 10*c*, wherein the first and second legs 13 and 14 are of a configuration as set forth in FIGS. 1 and 2 for example, but wherein the first leg 13 and the associated interior surface 15 mounts a "V" shaped knife 29 that is of a tapered configuration whose edge is aligned with the interior surface 15 adjacent the first side edge 30 of the first leg 13 and projects above the interior surface 15 adjacent the second side edge 31 of the first leg 13, wherein the first and second side edges are arranged generally parallel relative to one another, as illustrated in FIG. 8. The second interior surface 16 of the second leg 14 is provided with a "V" shaped groove 28 to receive the "V" shaped knife 29 therewithin. It is understood therefore that upon a closure and directing of the first and second legs together, the upper edge of the "V" shaped knife 29 adjacent the first edge 30 will project above the second interior surface 16, inasmuch as the "V" shaped groove is defined by a predetermined depth less than that of the predetermined height of the "V" shaped knife 29 adjacent the second side edge 31 defined as the second end of the "V" shaped knife opposed to the first end of the "V" shaped knife adjacent the first side edge 14. The bag 11 is thereby accommodated between the "V" shaped knife 29 and the second interior surface 16 to permit directing of the apparatus across the bag surface for severing and removal of the bag seam 12 from the bag 11.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bag opener apparatus comprising, a "U" shaped body, the "U" shaped body including a first leg spaced from and parallel to a second leg in a first position and in an unparallel relationship in a second position when the first and second legs are squeezed together relative to one another, and the first and second legs joined together, including an elongate arcuate intersection, the "U" shaped body formed of a memory retentive deformable material, and the first leg including a first interior surface, and the second leg including a second interior surface, wherein the first and second interior surfaces are parallel relative to one another in the first position, and the first and second legs coextensively aligned relative to one another in the first position, and knife means mounted to the first interior surface to effect severing of a bag directed between the first and second interior surfaces, and wherein the knife means includes an elongate knife defined by a "V" shaped cross-sectional configuration, and wherein the first leg includes a first side edge spaced from and parallel to a second side edge, and the "V" shaped knife aligned with the first interior surface at the first side edge and extending above the first interior surface at the second side edge a predetermined height, and including an elongate groove defined by a "V" shaped cross-sectional configuration aligned with the knife, wherein the groove is formed within the second interior surface, and the knife and the groove are aligned relative to one another, and wherein the first leg includes a first beveled terminal end edge, and the second leg includes a second beveled terminal end edge, wherein the first and second beveled end edges are in confronting relationship to receive the bag therebetween, and wherein the groove is defined by a predetermined depth, the predetermined depth less than that defined by the predetermined height of the knife adjacent the second side edge.

* * * * *